US006045493A

United States Patent [19]

Totani

[11] Patent Number: 6,045,493

[45] Date of Patent: Apr. 4, 2000

[54] SHEET MATERIAL FEEDING APPARATUS

[75] Inventor: Mikio Totani, Muko, Japan

[73] Assignee: Totani Giken Kogyo Co., Ltd., Kyoto, Japan

[21] Appl. No.: 09/016,650

[22] Filed: Jan. 30, 1998

[30] Foreign Application Priority Data

Jan. 30, 1997 [JP] Japan ..... 9-033264

[51] Int. Cl.[7] ..... B31B 1/08

[52] U.S. Cl. ..... 493/201; 493/212; 493/223; 493/929; 53/133.2; 198/468.1; 198/689.1; 198/740; 271/268

[58] Field of Search ..... 493/200, 201, 493/190, 209, 212, 223, 929; 53/133.2; 198/468.1, 740, 689.1; 271/85, 194, 268

[56] References Cited

U.S. PATENT DOCUMENTS

| | | | |
|---|---|---|---|
| 3,477,558 | 11/1969 | Fleischauer | 198/184 |
| 3,684,081 | 8/1972 | Matsuo | 198/184 |
| 3,850,287 | 11/1974 | Petros | 198/219 |
| 3,888,395 | 6/1975 | Burt, Jr. et al. | 223/1 |
| 4,108,712 | 8/1978 | Bala et al. | 156/498 |
| 4,646,911 | 3/1987 | Pearl et al. | 198/689.1 |
| 5,250,246 | 10/1993 | Totsuka | 264/138 |
| 5,540,802 | 7/1996 | Totani | 156/359 |
| 5,807,222 | 9/1998 | Totani | 493/22 |

*Primary Examiner*—Joseph J. Hail, III
*Assistant Examiner*—William Hong
*Attorney, Agent, or Firm*—Morgan & Finnegan, L.L.P.

[57] ABSTRACT

There is disclosed an apparatus for intermittently and successively feeding sheet materials such as plastic bags into a plurality of sheet material processing stations which are spaced from each other along the feeding passage of the sheet material. The apparatus comprises movable elongated member means extending parallel to the feeding direction of sheet material, a fixed elongated member means extending parallel to the feeding direction of sheet material and disposed side by side with the movable elongated member means. The movable elongated member means is reciprocatingly moved in the longitudinal direction thereof at a stroke corresponding to the distance between the processing stations. The sheet materials are held by the holding means of the movable elongated member means and released from the holding member of the fixed elongated member means when the movable elongated member means is forwardly moved. The sheet materials are held by the holding means of the fixed elongated member means and released from the holding means of the movable member means when the movable member means is reversely and backwardly moved.

12 Claims, 10 Drawing Sheets

SHEET MATERIAL FEEDING APPARATUS

FIELD OF THE INVENTION

The invention relates to an apparatus for intermittently and successively feeding sheet materials such as plastic bags into a plurality of sheet material processing stations which are spaced from each other along the feeding passage of sheet material.

PRIOR ART

There has been recently commercially available a plastic bag including a spout which is made of plastic material and adapted to direct a liquid such as a drink out of the plastic bag. The plastic bag has a certain shape including an open end which is obliquely cut at one corner thereof. The spout is inserted into the cut corner of the open end, the plastic bag and the spout being heat sealed with each other to adhere the plastic bag to the spout. The plastic bag and the spout may be ultrasonic wave sealed with each other to adhere the plastic bag to the spout. The liquid is then poured and charged into the plastic bag from the open end thereof, in a liquid charging apparatus.

Under the circumstances, it has been intended to intermittently and successively feed plastic bags into a plastic bag corner cutting station, and successively and obliquely cut the plastic bags at one corners of the open ends of the plastic bags at the corner cutting station, in an apparatus. It has been also intended to then intermittently and successively feed the plastic bags into a plastic bag heat sealing or ultrasonic wave sealing station, and successively heat seal or ultrasonic wave seal the plastic bags and the spouts with each other at the sealing station, in the apparatus. However, in this case, it is required not only to intermittently and successively feed plastic bags into the corner cutting station and the sealing station, but also to successively and conveniently stop and hold the plastic bags at the corner cutting station and the sealing station. It therefore has a problem that the apparatus has to be large-sized and complicated.

SUMMARY OF THE INVENTION

It is therefore an object of the invention to provide a novel and improved apparatus for intermittently and successively feeding sheet materials such as plastic bags into a plurality of sheet material processing stations which are spaced from each other along the feeding passage of the sheet material, to thereby overcome the above problems.

Other object of the invention Is to provide an apparatus which not only intermittently and successively feed the sheet materials into the sheet material processing stations, but also successively and conveniently stop and hold the at materials at the sheet material processing stations.

Another object of the invention is to provide an apparatus which has a miniaturized and simple structure to accomplish the intended purpose.

According to the invention, the apparatus comprises movable elongated member means extending parallel to the feeding direction of sheet material. The movable elongated member means includes seat material holding means for holding and releasing the sheet materials. The apparatus further comprises fixed elongated member means extending parallel to the feeding direction of sheet material and disposed side by side with the movable elongated member means. The fixed elongated member means also includes sheet material holding means for holding and releasing the sheet materials.

Drive means is connected to the movable elongated member means, the movable elongated member means being reciprocating moved in the longitudinal direction thereof by the drive means at a stroke corresponding to the distance between the processing stations. Activating means is provided for activating the holding means of the movable and fixed elongated member means so that the sheet materials are held by the holding means of the movable elongated member means and released from the holding means of the fixed elongated means when the movable elongated member means is forwardly moved. The sheet materials are held by the holding means of the fixed elongated menber means and released from the holding means of the movable member means when the movable member means is reversely and backwardly moved.

The movable elongated member means may conpirse a plurality of movable elongated members. The fixed elongated member means may comprise a plurality of fixed elongated members, the movable and fixed elongated members being disposed side by side and alternately with each other.

In a preferred embodiment, the movable and fixed elongated member means comprise movable and fixed lower beam means each including top surface means, the top surface means of the movable and fixed lower beam means being flush with each other. The sheet materials are held on the top surface means of the movable or fixed lower bean means.

At least one of the movable and fixed elongated member means may further comprise movable or fixed upper beam means disposed above the movable or fixed lower beam means. The holding means may comprise a plurality of clamp pads opposed to the top surface means of the movable or fixed lower beam means. The activating means may comprise drive means mounted on the movable or fixed upper beam and connected to the clamp pads for moving the clamp pads downward toward the top surface means to clamp and hold the sheet materials between the clamp pads nd the top surface means.

The holding means may comprise a plurality of suction holes formed in the top surface means of at least one of the movable and fixed lower beam means. The activating means may comprise vacuum means connected to the suction holes for making the suction holes vacuous to thereby suctionally hold the sheet materials.

In other embodiment, the movable elongated member means comprises movable upper and lower beam means. The fixed elongated miner means comprises fixed lower beam means. The movable upper beam means is disposed above the movable lower beam means and the fixed lower beam means. The holding means comprises a plurality of first upper and lower pairs of clamp pads opposed to each other and disposed between the movable upper and lower beam means, and a plurality of second upper and lower Pairs of clamp pads opposed to each other and disposed between the movable upper beam means and the fixed lower beam means. The activating means comprises a plurality of first upper and lower pairs of drive means and a plurality of second upper and lower pairs of drive means. The first upper and lower drive means are molted on the movable upper and lower beam means and connected to the first upper and lower clamp pads respectively for moving the first upper and lower clamp pads downward and upward toward each other to clamp and hold the sheet materials between the first upper and lower clamp pads. The second upper and lower drive means are mounted on the movable upper beam means and the fixed lower beam means and connected to the second upper and lower clamp pads respectively for moving the second upper and lower clamp pads downward and upward toward each other to clamp and hold the sheet materials between the second upper and lower clamp pads, and then moving the second upper clamp pads upward from the second lower clamp pads. The second lower clamp pads comprise vacuum pads vacuum means being connected to the vacuum pads for making the vacuum pads vacuous to suctionally hold the sheet material when and after moving the second upper clamp pads upward from the second lower clamp pads.

The movable upper beam means may be disposed above the movable lower beam means. The fix elongated member means may comprise fixed upper and lower beam means. The fixed upper beat means is disposed above the fixed lower beam means. The second upper and lower clamp pads may be disposed between the fixed upper and lower beam means. The second upper and lower drive means may be mounted on the fixed upper and lower beam means and connected to the second upper and lower clamp pads respectively for moving the second upper and lower pads downward and upward toward each other to clamp and hold the sheet materials between the second upper and lower clamp pads The apparatus may further comprise sheet material supply and discharge stations positioned at the opposite ends of the movable and fixed elongated member means in the longitudinal direction thereof, first delivery means for holding the sheet material at the supply station, and second delivery means for holding the sheet material at the last processing station. The first and second delivery means are mounted on and moved integrally with the movable elongated member means for intermittently and successively feeding the sheet materials into the first processing station from the supply station and into the discharge station from the last processing station.

The sheet material may comprise a plastic bag which has a certain shape including an open end. The processing stations may comprise a plastic bag conmer cut station, a plastic bag opening station and a plastic bag heat sealing or ultrasonic wave sealing station. The apparatus may be arranged to intermittently and successively feed the plastic bags into the conmer cut station, the opening station and the heat sealing or ultrasonic wave sealing station in such a manner that the plastic bags inclined at an angle with respect to the feeding direction thereof and the open end comprise the trailing ends of the plastic bags in the feeding direction thereof. The apparatus may further comprise a cutter disposed at the conmer cut station for obliquely cutting the plastic bag at one corner of the open end of the plastic bag, an opening device for opening the open end of the plastic bag at the opening station, and pickup fingers fin adapted to grasp an accessary such as a spout for inserting it into the cut corner of the open end. The opening device is mounted on and moved integrally with the movable elongated member means to intermittently feed the plastic bag with the open end opened into the heat sealing or ultrasonic wave sealing station. The pickup fingers arm rotatingly moved with timed relation to the plastic bag in the feeding direction of the plastic bag and toward the open end of the plastic bag to insert the accessary into the out corner of the open end at the heat sealing or ultrasonic wave station. The apparatus may further comprise a heat sealing or ultrasonic wave sealing device disposed at the heat sealing or ultrasonic wave sealing station for beat sealing or ultrasonic wave sealing the plastic bag and the accessary with each other to adhere the plastic bag to the accessary.

The apparatus may be arranged to intermittently and successively feed the plastic bags into the corner out station, the opening station and the heat sealing or ultrasonic wave sealing station in such a manner that the plastic bags are inclined at an angle with respect to the feeding direction thereof and the open ends comprise the leading ends of the plastic bags in the feeding direction thereof. The accessary may be previously moved by the pickup fingers into a position corresponding to the cut corner of the open end before the plastic bag reaches the heat sealing or ultrasonic wave sealing station, to insert the accessary into the cut corner through the open end when the plastic bag reaches the heat sealing or ultrasonic wave sealing station.

The apparatus may be arranged to intermittently and successively feed the plastic bags into the opening station and the heat sealing or ultrasonic wave sealing station in such a meaner that the plastic bags extend perpendicularly to the feeding direction thereof.

The pickup fingers may be adapted to grasp an accessary such as a spout including an elongated conduit for inserting it into the open end of the plastic bag. The pickup fingers are mounted on and moved integrally with the movable elongated member means and linearly moved toward the open end of the plastic bag to thereby insert the accessary into the open end of the plastic bag at the heat sealing or ultrasonic wave sealing station.

DESCRIPTION OF THE INVENTION

Figure 1:
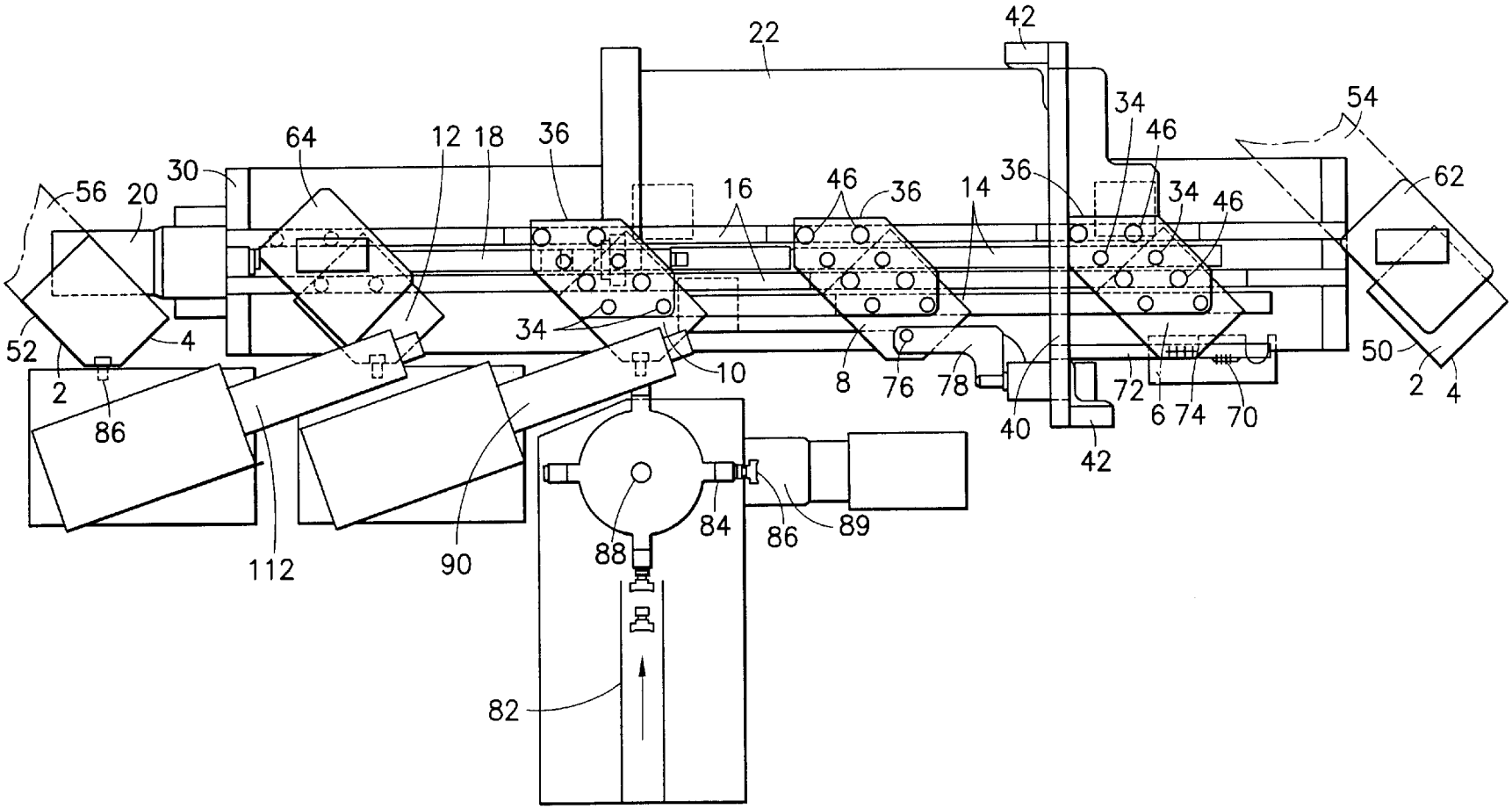
FIG. 1 is a plan view of a preferred embodiment of the invention.

Turning now to the drawings, FIG. 1 illustrates an apparatus for intermittently and successively feeding plastic bags 2 into a plurality of plastic bag processing stations according to the invention. The plastic bag 2 has a rectangular shape including an open end 4. The processing stations comprise a plastic bag corner cut station 6, a plastic bag opening station 8, a plastic bag heat sealing station 10 and a plastic bag cooling station 12, which are spaced from each other along the feeding passage of plastic bag 2 at a distance. The apparatus is arranged to intermittently and successively feed the plastic bags 2 into the corner cut station 6, the opening station 8, the heat sealing station 10 and the cooling station 12 in such a manner that the plastic bags 2 are inclined at an angle of 45° with respect to the feeding direction thereof and the open ends 4 comprise the trailing ends of the plastic bags 2 in the feeding direction thereof.

The apparatus comprise movable elongated inter means ending parallel to the feeding direction of plastic bag 2 and find elongated member means extending parallel to the reading direction of plastic bag 2 and disposed side by side with the movable elongated member. The movable elongated member means comprises two movable lower beam 14 each including top surface, the fixed elongated member means comprising two fixed lower beams 16 each including top surface. The movable and fixed lower beam 14 and 16 are disposed side by side and alternately with each other, the top surfaces of the movable a fixed lower beam 14 and 16 being flush with each other. The plastic bags 2 are held on the top surfaces of the movable or fixed lower beams 14 and 16, as described later.

Figure 2:
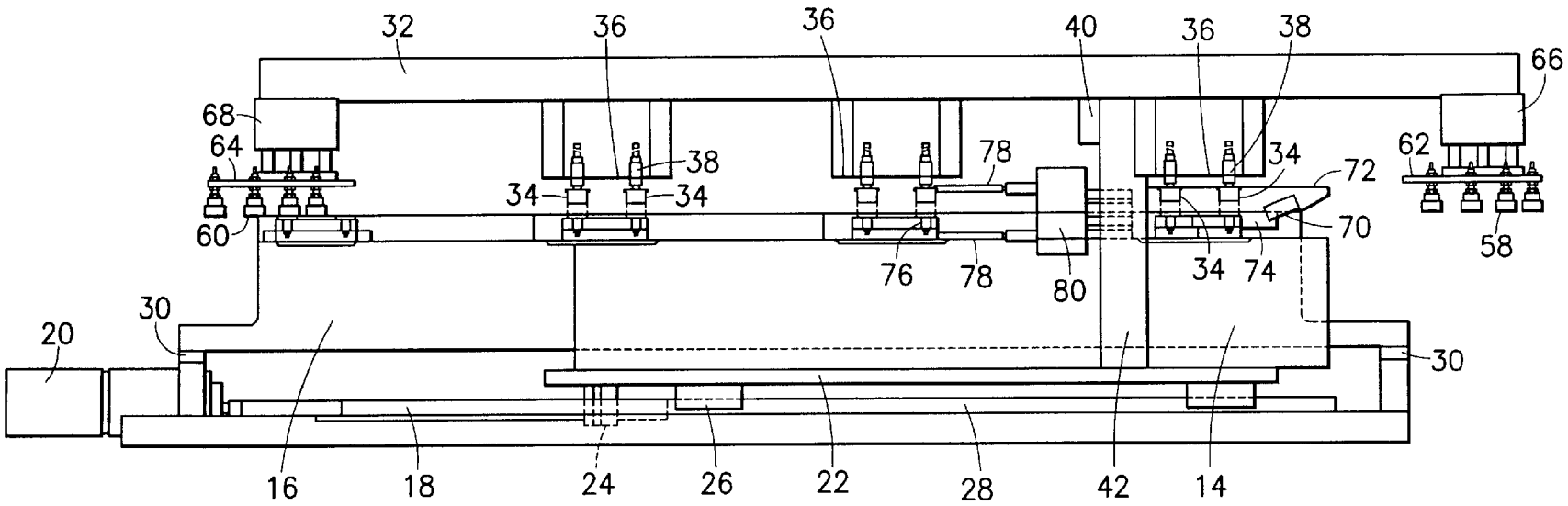
FIG. 2 is a side view of the apparatus in FIG. 1.
Figure 3:
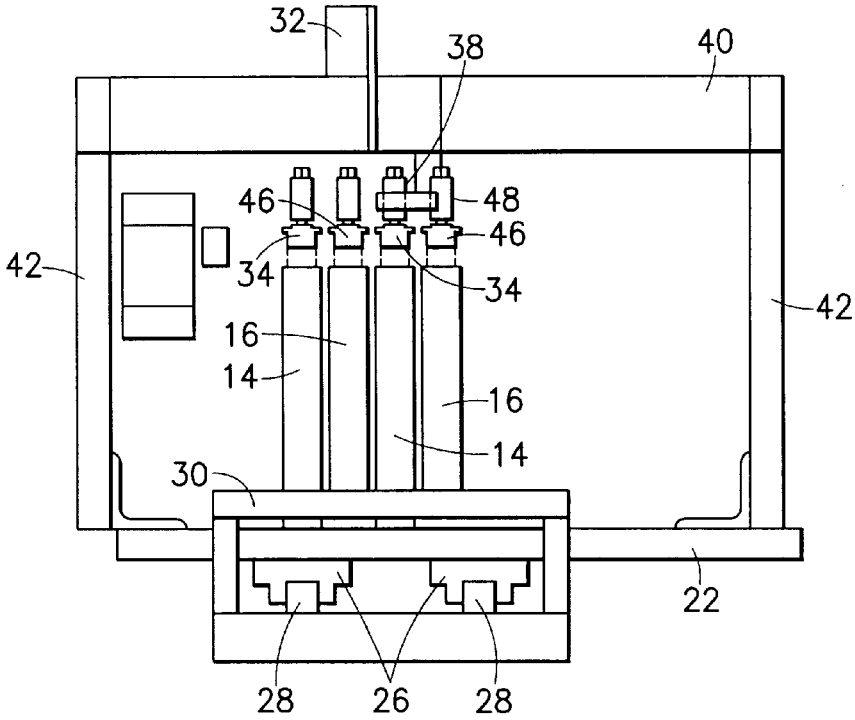
FIG. 3 is cross sectional view of the apparatus in FIG. 1.

The apparatus further comprises drive means connected to the movable lower beams 14. The drive means includes a screw rod 18 extending parallel to the movable lower beams 14 and connected to a servo motor 20, as shown in FIG. 2. The movable lower beams 14 are fixedly mounted on a bagse 22 including a nut member 24 which is threadedly engaged with the screw rod 18. The bagse 22 is mounted on and supported by carriages 26 which are fitted onto and with guide rails 28 for linearly movement, as shown in FIG. 3. The guide rails 28 extend parallel to the movable lower beams 4 and the screw rod 18. The screw rod 18 is rotated and then reversely rotated by the servo motor 20 so that the movable lower beams 14 and the bagse 22 are reciprocatingly moved in the longitudinal direction of the movable lower beams 14 along the guide rails 28 by the screw rod 18 and the nut member 24 at a stroke corresponding to the distance between the processing stations 6 to 12. The fixed lower beams 16 and fixedly mounted at opposite ends on supports 30.

The movable elongated member means includes plastic bag holding means for holding and releasing the plastic bags 2. The fixed elongated member means also includes plastic bag holding means for holding and releasing the plastic bags 2. In this connection, the apparatus further comprises activating means for activating the holding means of the movable and fixed elongated member means.

In the embodiment, the movable elongated member means includes a movable upper beam 32 disposed above and extending parallel to the movable lower beams 14. The holding means comprise a plurality of clamp pads 34. The movable upper beam 32 includes three holders 36 for clamp pads 34 mounted thereon, two pairs of the clamp pads 34 being positioned at each holder 36. One of the pairs of clamp pads 34 are spaced from each other in the feeding direction of plastic bag 2 and opposed to one of the top surfaces of the movable lower beams 14, the other pair of clamp pads 34 being spaced from each other in the feeding direction of plastic bag 2 and opposed the other top surface of the movable lower beam 14. The holders 36 are from each other at a distance which corresponds to the distance between the processing stations 6 to 12 in the feeding direction of the plastic bag, two pairs of clamp pads 34 being carried by each holder 36. The activating means comprises a plurality of air or hydraulic cylinders 38, two-pairs of which are mounted on each holder 36 and connected to the pairs of clamp pads 34 for moving the clamp pads 34 downward toward the top surfaces of the movable lower beams 14 to clamp and hold the plastic bag 2 between the clamp pads 34 and the top surfaces. The movable upper beam 32 is mounted on and supported by a cross member 40 the opposite ends of which are mounted on pillars 42. The pillars 42 am fixedly mounted on the bagse 22 so that the clamp pads 34, the holders 36 and the movable upper beam 32 are moved integrally with the movable lower beams 14 and the bagse 22.

Figure 4:
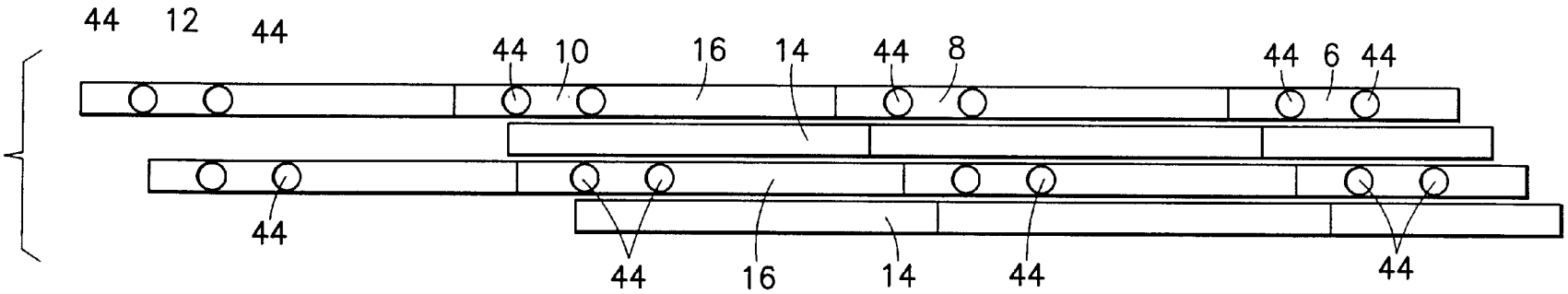
FIG. 4 is a plan view of the movable and fixed lower beams in FIG. 1.

As to the fixed lower beams 16, the holding means comprise a plurality of suction holes 44 formed in the top surfaces of the fixed lower beams 16, two pairs of the suction holes 44 being positioned at each processing station 6 to 12, as shown in FIG. 4. At each prosing station 6 to 12, one of the pairs of suction holes 44 are spaced from each other in the feeding direction of plastic bag 2 and formed in one of the top surfaces of the fixed lower beams 16, the other pair of suction holes 44 being spaced from each other in the feeding direction of plastic bag 2 and formed in the other top surface of the fixed lower beam 16. The activating means comprises vacuum such as a vacuum blower not shown. The vacuum blower is connected by means of a switch valve to flow paths formed in the fixed lower beams 16 and communicated with the suction holes 44. The switch valve can be actuated for making the suction holes 44 vacuous to thereby suctionally hold the plastic bags 2.

In addition, the holders 36 include a plurality of pusher pads 46, two pairs of pusher pads 46 being carried by each holder 36. On each holder 36, one of the pairs of pusher pads 46 are spaced from each other in the feeding direction of plastic bag 2 and opposed to one of the top surfaces of the fixed lower beams 16 at positions corresponding to the suction holes 44 therein, the other pair of pusher pads 46 being spaced from each other in the feeding direction of plastic bag 2 and opposed to the other top surface of the fixed lower beam 16 at positions corresponding to the suction holes 44 therein. The holders 36 further include a plurality of air or hydraulic cylinders 48, two pairs of which are mounted on each holder 36 and connected to the pairs of pusher pads 46 for moving the pusher pads 46 downward toward the top surfaces of the fixed lower beams 16 to push downward the plastic bag 2 toward the suction holes 44 in the fixed lower beams 16.

By the way, the vacuum blower may be connected only to the flow path formed in one of the fixed lower beams 16, which is disposed between the movable lower beam 14, for making the suction holes 44 vacuous to suctionally hold small plastic bag. In the case, as to the pusher pads 46 opposed to the top surface of the other fixed lower beam 16 which is disposed on the outside of the movable loser beams 14, the pusher pads 46 and the cylinders 48 may removed from the holders 36.

The apparatus further comprises plastic bag supply and discharge stations 50 and 52 positioned at the opposite ends of the movable and fixed lower beans 14 and 16 in the longitudinal direction thereof. A conveyor 54 is provided for intermittently and successively feeding the plastic bags 2 one by one into the supply station 50. A conveyor 56 is provided for discharging the plastic bags 2 from the discharge station 52. In addition, the apparatus further includes first delivery means comprising a plurality of suction members 58 for holding the plastic bag 2 at the supply station 50. The apparatus includes second delivery means comprising a plurality of suction members 60 for holding the plastic bag 2 at the last processing station or the cooling station 12. The suction members 58 and 60 are mounted on and carried by holders 62 and 64 at positions corresponding to the suction holes 44 in the fixed lower beams 16. Air or hydraulic cylinders 66 and 68 are mounted on the movable upper beam 32 and connected to the holders 62 and 64 so that the suction members 58 and 60 are moved integrally with the movable lower and upper beams 14 and 32, for moving the holders 62 and 64 downward toward the plastic bags 2. The holders 62 and 64 are spaced from the holder 36 for the clamp pads 34 at a distance which corresponds to the distance between the processing stations 6 to 12 and the stroke at which the movable lower beams 14 are reciprocatingly moved. The cylinders 66 and 68 can move the holders 62 and 64 downward toward the plastic bags 2. In addition, the vacuum blower is connected to the suction members 58 and 60 by means of switch valves. The switch valve can be actuated for making the suction members 58 and 60 vacuous to suctionally hold the plastic bags 2 at the supply station 50 and the cooling station 12.

The conveyor 54 is inclined at an angle of 45° with respect to the movable and fixed lower beams 14 and 16 in the supply station 50, to intermittently and successively feed the plastic bags 2 into the processing stations 6 to 12 so that the plastic bags 2 at inclined at an angle of 45° with respect to the feeding direction thereof and the open ends 4 comprise the trailing ends of the plastic bags 2 in the feeding direction thereof. The conveyor 56 is also inclined at an angle of 45° with respect to the movable and fixed lower beams 14 and 16.

A cutter or knife 70 is disposed at the corner cutting station 6 and mounted on a bracket 72. A receiving member 74 is disposed and fixed at the corner cutting station 6. The bracket 72 is mounted on the cross member 40 so that the cutter 70 cooperates with the receiving member 74 to obliquely cut the plastic bag 2 at one conmer of the plastic bag 2 when the movable lower beams 14 are reversely moved, as described later.

An opening device is disposed at the opening station 8. The opening device includes upper and lower suction members 76 opposed to each other and mounted on upper and lower arms 78. Air or hydraulic cylinders 80 are connected to the upper a lower arms 78 for moving the upper and lower arms 78 downward and upper toward other to clam the plastic bag 2 between the upper and lower suction 76. The vacuum means such as the vacuum blower is connected to the upper and lower suction members 76 by means of a switch valve. The switch valve can be actuated for making the upper and lower suction members 76 vacuous to suctionally hold the plastic bag 2. The cylinders 80 then move the upper and lower arm 78 upward and downward for opening the open end 4 of the plastic bag 2 at the opening station 8. The cylinders 80 are mounted on the pillar 42 so that the opening device is moved integrally with the movable lower and upper 14 and 32 to intermittently feed the plastic bag 2 with the open end 4 opened into the heat sealing station 10.

A spout feeder 82 and pickup fingers 84 are disposed at the heat sealing station 10. The spout feeder 82 intermittently and successively feeds spouts 86 one by one. The pickup fingers 84 grasp the spout 86 fed by the spout feeder 82. The pickup fingers 84 are then driven for rotation counterclockwise about an axis 88 to feed the spout 86 to a pre-heating device 89 from the spout feeder 82. The pre-heating device includes upper and lower heaters opposed each other and clamps the spout 86 between the upper and lower heaters for pre-heating the spout 86. The pickup fingers 84 are then again driven for rotation counter clockwise about the axis 88 so that the pickup fingers 84 are rotationally moved with timed relation to the plastic bag 2 in the feeding direction of the plastic bag 2 and toward the open end 4 of the plastic bag 2 to insert the spout 86 into the cut corner of the open end 4 at the heat sealing station 10.

Figure 5:
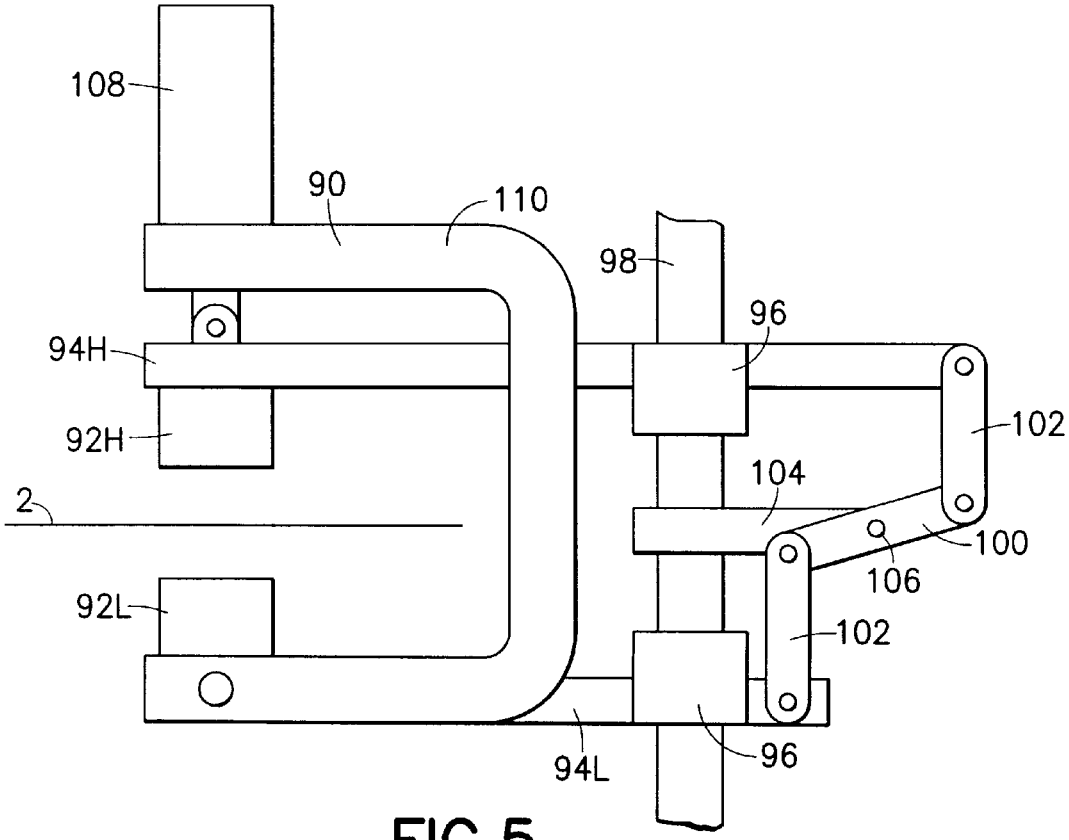
FIG. 5 is a schematic view of the heat sealing device in FIG. 1.

A heat sealing device 90 is disposed at the heat sealing station 10. The heat sealing device 90 includes upper and lower heaters 92H and 92L opposed to each other and mounted on upper and lower bars 94H and 94L, as shown in FIG. 5. The upper and lower bars 94H and 94L are fixedly mounted on guide members 96 which art fitted onto and engaged with a pillar 98 for linearly movement. The upper and lower bars 94H and 94L are connected to a lever 100 by of links 102 respectively. The lever 100 is mounted on a bracket 104 for swingingly movement about a support 106, the bracket 104 being fixedly mounted on the pillar 98. An air or hydraulic cylinder 108 is mounted on a reactive member 110 and connected to the upper bar 94H. The reactive member 110 is mounted on and supported by the lower bar 94L so that the cylinder 108 cooperates with the reactive member 110, the links 102 and the lever 100 for moving the upper and lower bars 94H and 94L downward and upward toward each other to clamp the plastic bag 2 and the spout 86 between the upper and lower heaters 92H and 92L. The plastic bag 2 and the spout 86 are heated and pressurized by the upper and lower heaters 92H and 92L for heat sealing the plastic bag 2 and the spout 86 with each other to adhere the plastic bag 2 to the spout 86.

A cooling device 112 is disposed at the cooling station 12. The cooling device 112 has the substantially sang structure as the heat sealing device 90 except that it includes not the upper and lower heaters 92H and 92L but upper and lower coolers. Accordingly, an air or hydraulic cylinder cooperates with a reactive member, links and a lever for moving upper and lower bars downward and upward toward each other to clamp the plastic bag 2 and the spout 86 between the upper and lower coolers. The coolers and cool the plastic bag 2 and the spout 86.

In the apparatus, in the first place, the cylinder 66 moves the holder 62 and the suction members 58 downward toward the plastic bag 2 at the supply station 50. The switching valve is actuated for making the suction members 58 vacuous to suctionally hold the plastic bag 2. The cylinder 66 then moves the holder 62 and the suction member 58 upward to lift the plastic bag 2.

The screw rod 18 is then rotated by the servo motor 20 so that the movable lower and upper beams 14 and 32 and the bagse 22 are forwardly moved along the guide rails 28. The suction members 58 are moved integrally with the movable lower and upper beams 14 and 32 at a stroke corresponding to the distance between the supply station 50 and the corner cutting station 6 to feed the plastic bag 2 to the corner cutting station 6 from the supply station 50.

The cylinder 66 moves the suction members 58 downward again at the corner cutting station 6 in the position corresponding to the suction holes 44 in the fixed lower beams 16 to push the plastic bag 2 against the suction holes 44 in the fixed lower beams 16. The switching valve is actuated for making the suction holes 44 vacuous to thereby suctionally hold the plastic bag 2. As to the suction member 58, the switching valve is actuated to release the plastic bag 2 from the suction members 58. The cylinder 66 than moves the suction member 58 upward from the plastic bag 2.

Accordingly, the plastic bag 2 is held by the suction holes 44 in the fixed lower beams 16 and released from the suction member 58. The screw rod 18 is then rotated by the Servo motor 20 so that the movable lower and upper beams 14 and 32 are reversely and backwardly moved along the guide rails 28. The suction member 58 are moved integrally with the movable lower and upper beams 14 and 32 to the supply station 50.

The cylinders 38 then moves the clamp pads 34 downward toward the top surfaces of the movable lower beams 14 to clamp and hold the plastic bag 2 between the clamp pads 34 and the top surfaces at the corner cutting station 6, when the cylinder 66 moves the suction members 58 downward again at the supply station 50 for suctionally holding the plastic bag 2 at the supply station 4. As to the suction holes 44 in the fixed lower beams 16, the switching valve is actuated for releasing the plastic bag 2 from the suction holes 44. The cylinder 66 moves the suction members 58 upward to lift the plastic bag 2 at the supply station 4.

Accordingly, the plastic bags 2 are held by the clamp pads 34 and the suction members 58 of the movable lower and upper beams 14 and 32 and released from the suction holes 44 in the fixed lower beams 16. The movable lower and upper beam 14 and 32 are then forwardly moved. The clamp pads 34 are moved integrally with the movable lower and upper beams 14 and 32 to feed the plastic bags 2 to the opening station 8 from the corner cutting station 6 and to the corner cutting station 6 from the supply station 4.

The cylinder 48 then moves the pusher pads 46 downward at the opening station 8 in the positions corresponding to the suction holes 44 in the fixed lower beams 16 to push the plastic bag 2 against the suction holes 44 in the fixed lower beams 16, when the cylinders 66 move the suction members 58 downward to push the plastic bag 2 against the suction holes 44 at the cutting station 6. The switching valves are actuated for making the suction holes 44 vacuous to thereby suctionally hold the plastic bag 2 at the corner cutting station 6 and the opening station 8 and releasing the plastic bag 2 from the suction members 58. The cylinder 38, 48 and 66 then moves the clamp pads 34 the pusher pads 46 and the suction members 58 upward from the plastic bag 2.

Accordingly, the plastic bag 2 is held by the suction holes 44 in the fixed lower beams 16 and released from the clams pads 34 and the suction members 58 of the movable lower and upper beams 14 and 32. The screw rod 18 is then rotated by the servo Motor 20 so that the movable lower and upper beams 14 and 32 are reversely and backwardly moved along the guide rails 28.

The cylinder 68 then moves the holder 64 and the suction members 60 downward toward the plastic bag 2 at the cooling station 12, when the the cylinder 66 moves the suction members 58 downward at the supply station 50 and the cylinders 38 move the clamp pads 34 toward the top surfaces of the movable lower beams 14 at the corner cutting station 6, the opening station 8 and the heat sealing station 10. The switching valve is actuated for making the suction members 60 vacuous to suctionally hold the plastic bag 2. The cylinders 66 and 68 then move the suction members 58 and 60 upward to lift the plastic bags 2 at the supply station 50 and the cooling station 12.

The suction members 60 is moved integrally with the movable lower and upper beams 14 and 32 when the movable lower and upper beams 14 and 32 are forwardly moved, to feed the plastic bag 2 to the discharge station 52 from the cooling station 12. The switching valve is then actuated for releasing the plastic bag 2 from the suction members 60 at the discharge station 52. The plastic bag 2 is discharged from the discharge station 52 by the conveyor 56.

The apparatus can therefore intermittently and successively feed the plastic bags 2 into the corner cutting station 6, the opening station 8, heat sealing station 10 and the cooling station 12. The apparatus also can successively and conveniently stop and hold the plastic bags 2 at the corner cutting station 6, the opening station 8, heat sealing station 10 and the cooling station 12. Accordingly, it can successively and obliquely cut the plastic bags 2 at the corner cutting station 6, and successively heat seal the plastic bags 2 and the spouts 86 with each other to adhere the plastic bag 2 to the spout 86 at the heat sealing station 10. The apparatus can be a miniaturized and simple structure to accomplish the intended purpose.

In the apparatus, the cutter 70 is moved integrally with the bracket 72 and the movable lower and upper beams 14 and 32 and travelled along the receiving member 74 at the corner cutting station 4. The cutter 70 can therefore cooperate with the receiving member 74 to obliquely cut the plastic bag 2 at one corner of the open end 4 of the plastic bag 2 when the movable lower and upper beams 14 and 32 are backwardly moved.

The apparatus then feeds the plastic bag 2 to the opening station 8 from the corner cutting station 6. The opening device activates the upper and lower suction members 76 to suctionally hold and open the open end 4 of the plastic bag 2 at the opening station 8. The opening device is then moved integrally with the movable lower and upper beams 14 and 32 when the movable lower and upper beams 14 and 32 are forwardly moved along the guide rails 28, to intermittently feed the plastic bag 2 with the open end 4 opened into the heat sealing station 10.

Figure 6:
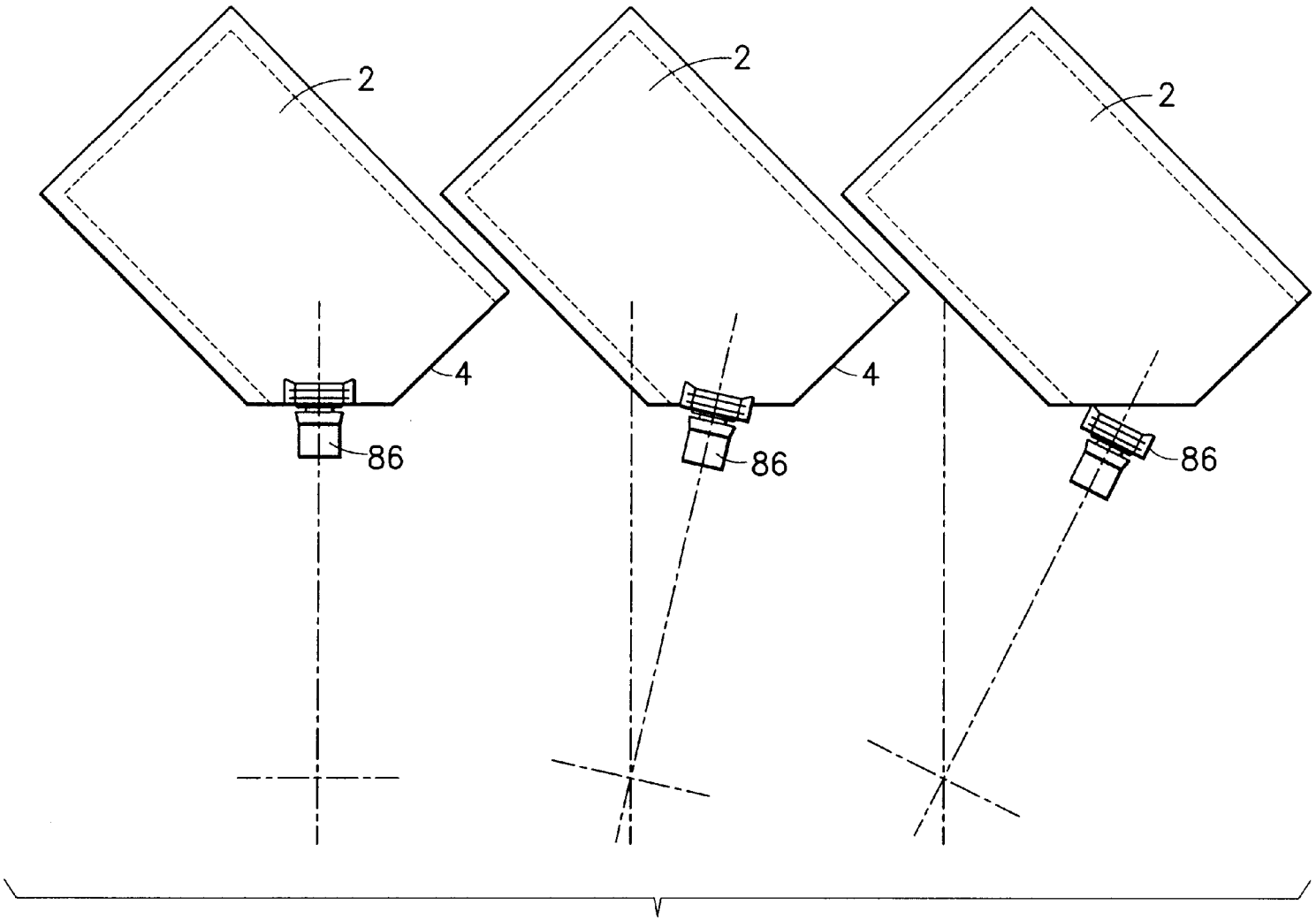
FIG. 6 is a schematic view of a spout inserted into the cut corner of the open end of a plastic bag in FIG. 1.

In addition, the pickup fingers 84 are rotationally moved with timed relation to the plastic bag 2 in the feeding direction of the plastic bag 2 and toward the open end 4 of the plastic bag 2 to insert the spout 86 into the cut corner of the open end 4, as shown in FIG. 6, at the heat sealing station 10. The upper and lower suction members 76 then release the plastic bag 2.

The heat sealing device 90 heat seals the plastic bag 2 and the spout 86 with each other to adhere the plastic bag 2 to the spout 86 at the heat sealing station 10. The apparatus then feeds the plastic bag 2 to the cooling station 12 from the heat sealing station 10. The cooling device 112 cools the plastic bag 2 and the spout 96 at the cooling station 12. The apparatus then feed the plastic bag 2 to the discharge station 52 from the cooling station 12. The conveyor 56 discharges the plastic bag 2 from the discharge station 52.

As to the holding means and the activating means of the fixed elongated member means, the fixed elongated member means may further comprise fixed upper beam means disposed above the fixed lower beams 16. The holding means may comprise a plurality of clamp pads opposed to the top surface of the fixed lower beams 16. The activating means may comprise drive means mounted on the fixed upper beam means and connected to the clamp pads for moving the clamp pads downward toward the top surfaces to clamp and hold th plastic bags 2 between the clamp pads and the top surfaces.

On the other hand, as to the holding means and the activating means of the movable elongated member means, the holding means may comprise a plurality of suction holes formed in the top surfaces of the movable lower beams 14. The activating means may comprise vacuum means connected to the suction holes for making the suction holes vacuous to thereby suctionally hold the plastic bags 2.

A ultrasonic wave sealing device may be substituted for the heat sealing device 90 and disposed at a ultrasonic wave station corresponding to the heat sealing station 10, for ultrasonic wave sealing the plastic bag 2 and the spout 86 to adhere the plastic bag 2 to the spout 86. In the case, it is not required to cool the plastic bag 2 and spout 86. The cooling station 12 and the cooling device device 112 can be removed.

Figure 7:
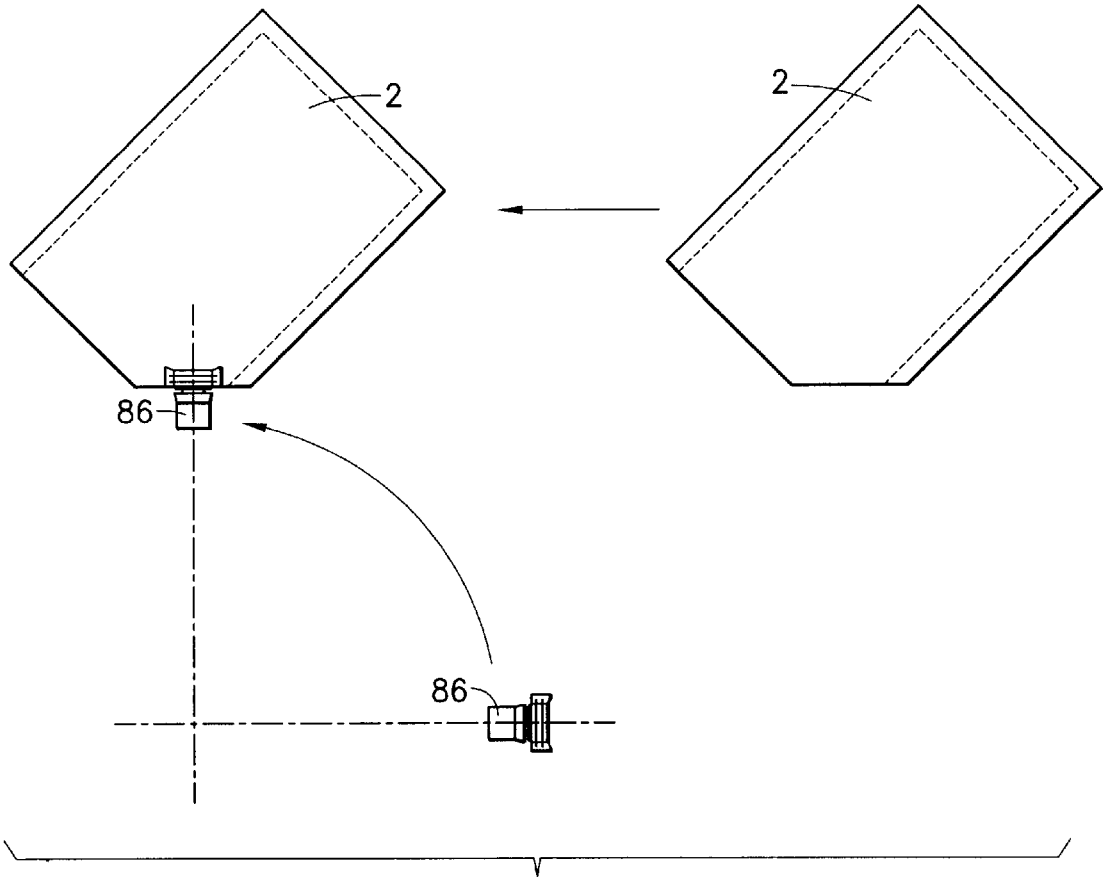
FIG. 7 is a schematic view of other embodiment.

The apparatus may be arranged to intermittently and successively feed the plastic bags 2 into the corner cut station 6, the opening station 8 and the heat sealing or ultrasonic wave sealing station 10 in such a manner that the plastic bags 2 are inclined at an angle with respect to the feeding direction thereof and the open ends 4 comprise not the trailing ends but the leading ends of the plastic bags 2 in the feeding direction thereof, as shown in FIG. 7. The spout 86 may be previously moved by the pickup fingers into a position corresponding to the cut corner of the open end 4 before the plastic bag 2 reaches the heat sealing or ultrasonic wave sealing station 10, to insert the spout 86 into the cut corner through the open end 4 n the plastic bag 2 reaches the heat sealing or ultrasonic wave sealing station 10.

Figure 8:
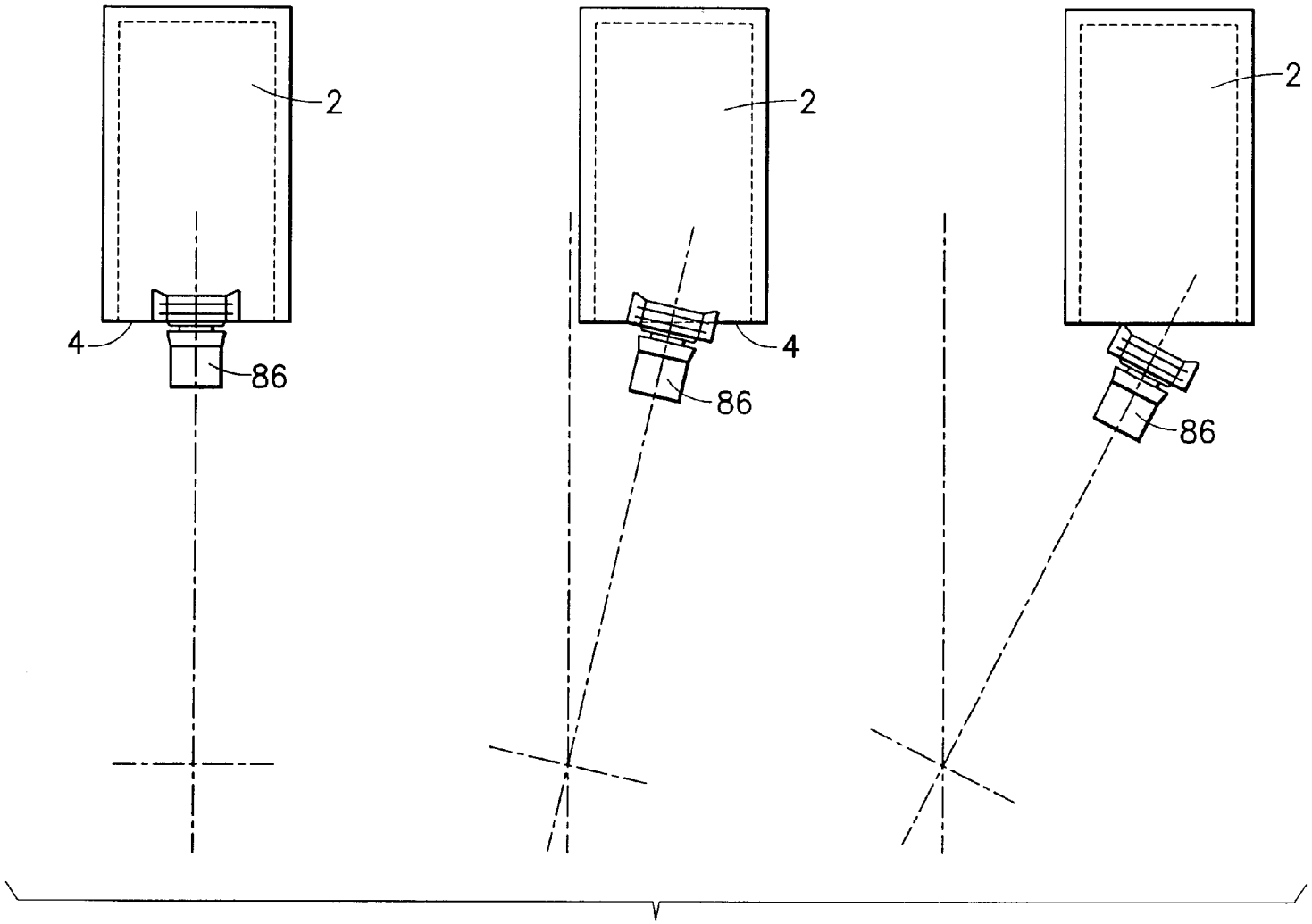
FIG. 8 is a schematic view of other embodiment.

The apparatus may be arranged to intermittently and successively feed the plastic bags 2 into the opening station 8 and the heat sealing or ultrasonic wave sealing station 10 in such a manner that the plastic bags 2 extend perpendicularly to the feeding direction thereof, as shown in FIG. 8. The pickup fingers 84 may be rotationally moved with timed relation to the plastic bag 2 in the feeding direction of the plastic bag 2 and toward the open end 4 of the plastic bag 2 to insert the spout 86 into the the open end 4 of the plastic bag 2 at the heat sealing or ultrasonic wave sealing station 10.

Figure 9:
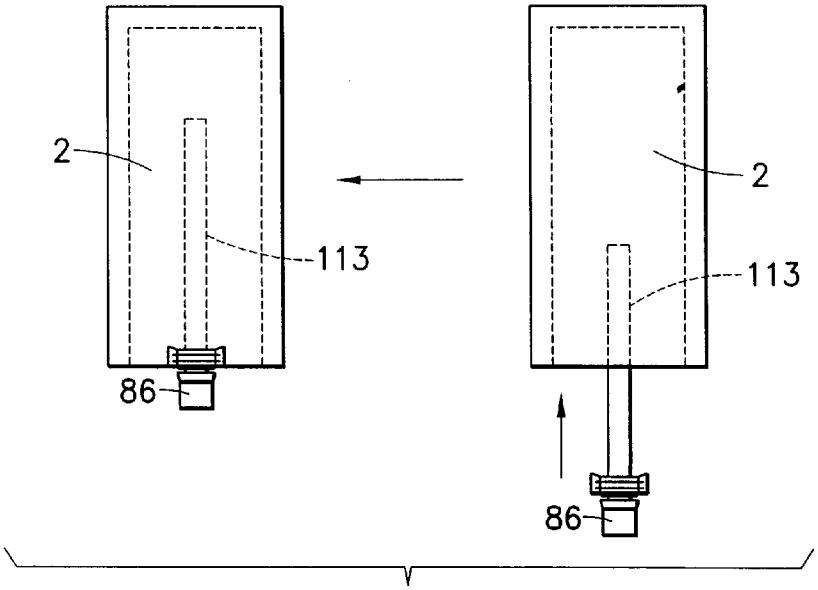
FIG. 9 is a schematic view of other embodiment.

It can be intended to insert a spout 86 including an elongated conduit 113 into the open end of the plastic bag 2, as shown in FIG. 9. In the embodiment, the pickup fingers are mounted on and moved integrally with the movable elongated member means and linearly moved toward the open end 4 of the plastic bag 2 to thereby insert the spout 86 into the open end 4 of the plastic bag 2 at the heat sealing or ultrasonic wave sealing station 10.

Figure 10:
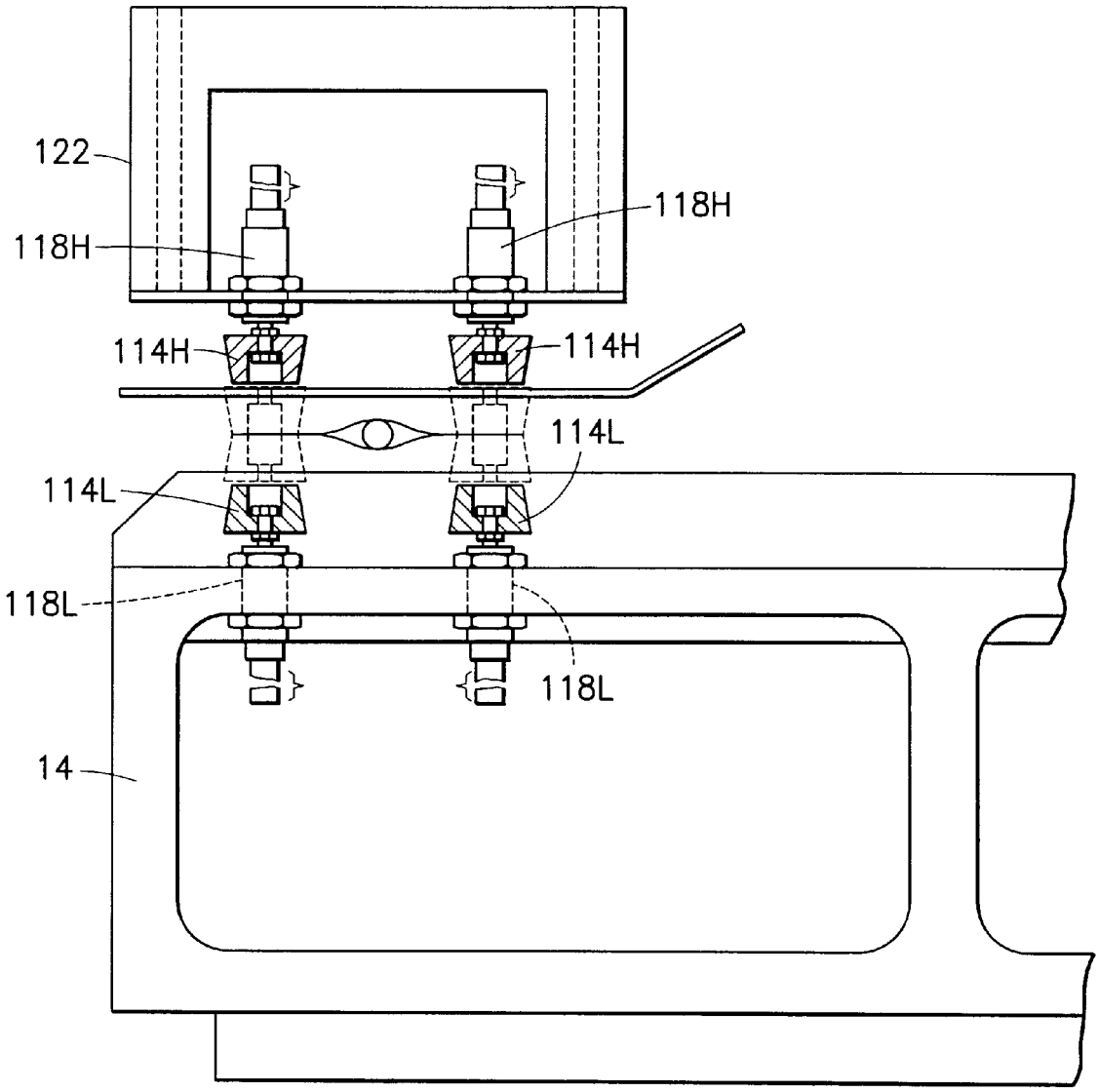
FIG. 10 is a side view showing first upper and lower clamp pads of other embodiment.
Figure 11:
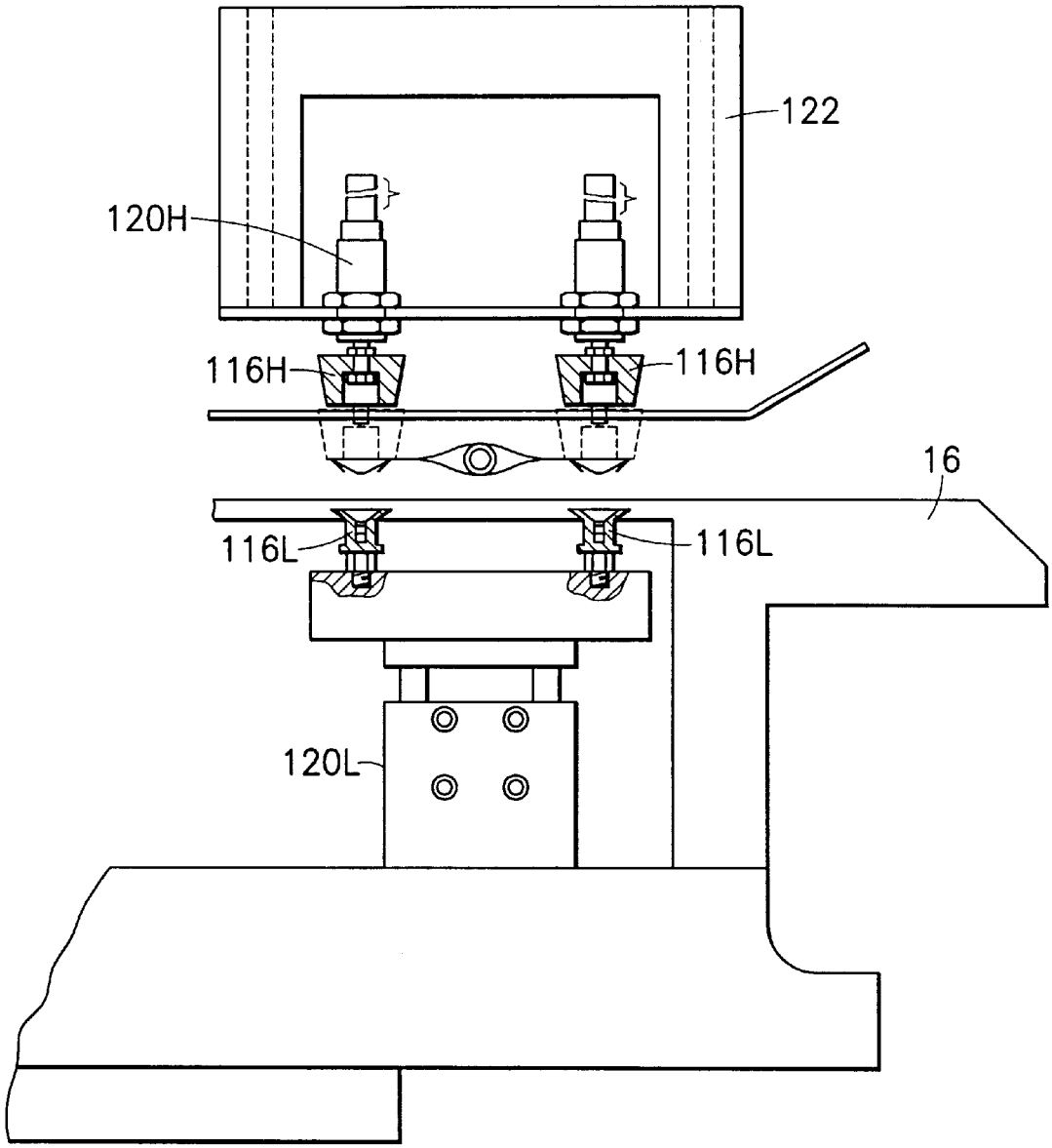
FIG. 11 is a side view showing send upper and lower clamp pads of the apparatus in FIG. 10.
Figure 12:
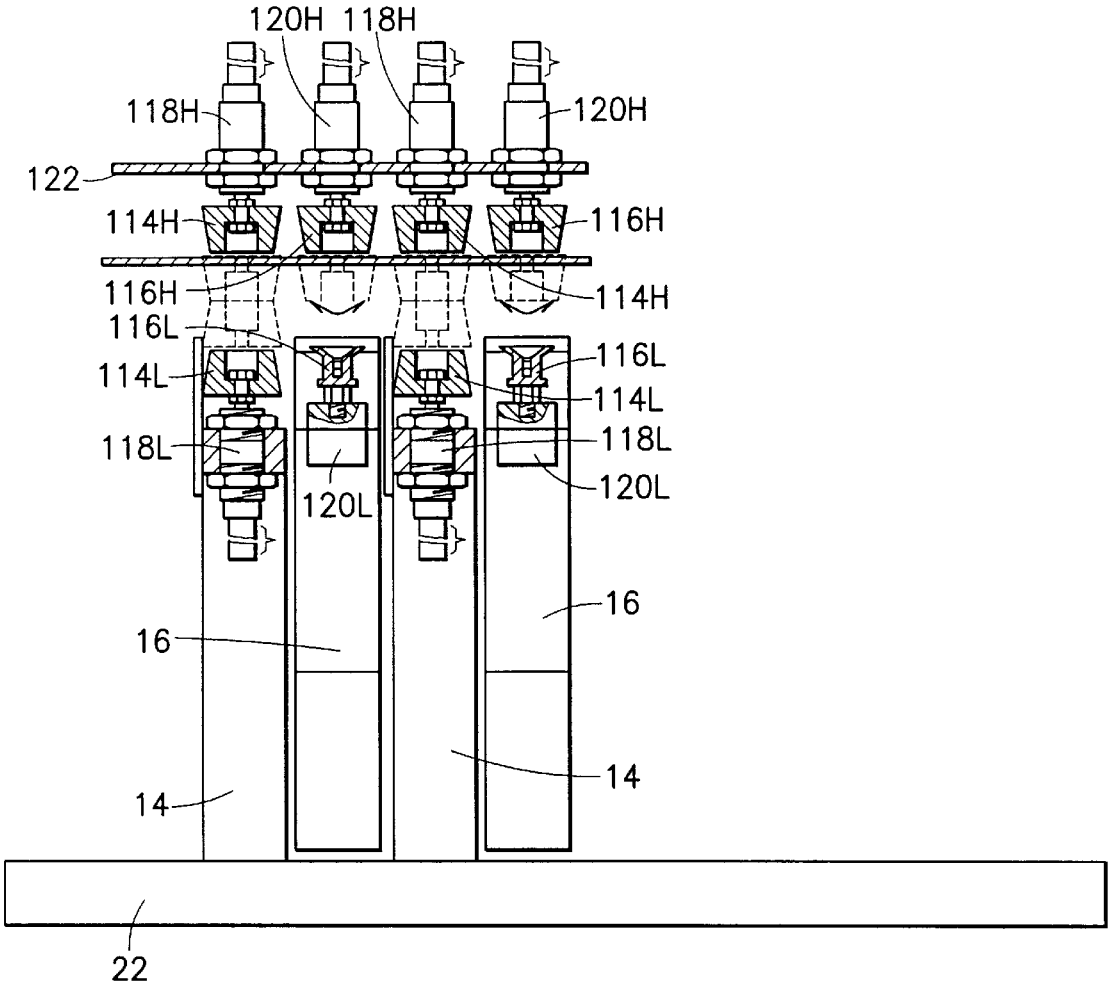
FIG. 12 is a cross sectional view of the apparatus in FIGS. 10 and 11.

In other embodiment as shown in FIGS. 10, 11 and 12, the movable upper beam 32 is disposed above the movable lower beams 14 and the fixed lower beams 16. The holding means comprises a plurality of first upper and lower pairs of clamp pads 114H and 114L opposed to each other and disposed between the movable upper and lower beams 32 and 14. The holding means further comprises a plurality of second upper and lower pairs of clamp pads 116H and 116L opposed each other and disposed between the movable upper beams 32 and the fixed lower beams means 16.

The activating means includes a plurality of first upper and lower pairs of drive means comprising air or hydraulic cylinders 118H and 118L. The upper and lower cylinders 118A and 118L arm mounted on the movable upper and lower beams 32 and 14 and connected to the first upper and lower clamp pads 114H and 114L respectively for moving the first upper and lower clamp pads 114H and 114L downward and upward toward each other to clamp and hold the plastic bags 2 between the first upper and lower clamp pads 114H and 114L.

The activating means further includes a plurality of second upper and lower pairs of drive means comprising air or hydraulic cylinders 120H and 120L. The upper and lower cylinders 120H and 120L are mounted on the movable upper beam 32 and the fixed lower beams 16 and connected to the second upper and lower clamp pads 116H and 116l respectively for moving the second upper and lower clamp pads 116H and 116L downward and upward toward each other to clamp and hold the plastic bags 2 between the second upper and lower clamp pads 116H and 116l, and then moving the second upper clamp pads 116H upward from the second lower clamp pads 116L. The second lower clamp pads 116L comprise vacuum pads, vacuum means being connected to the vacuum pads 116L for making the vacuum pads 116L vacuous to suctionally hold the material when and after moving the second upper clamp pads 116H upward from the second lower clamp pads 116L.

Accordingly, the plastic bags 2 can be held by the first upper and lower clamp pads 114H and 114L of the movable upper and lower beams 32 and 14 and released from the second or clamp pads 116L of the fixed lower beam 16 when the movable upper and lower beams 32 and 14 is forwardly moved, to intermittently and successively feed the plastic bags 2. The plastic bags 2 can be held by the second lower clamp pads 116L of the fixed lower beam 16 and released from the first upper and lower clamp pads 114H and 114L of the movable upper and lower beams 32 and 14 when the movable upper and lower beam 32 and 14 is reversely and backwardly moved, to successively an conveniently hold the plastic bags 2.

The embodiment can clamp and hold the plastic bags 2 between the first upper and lower clamp pads 114H and 114L or the second upper and lower clamp pads 116H and 116L, without engaging the plastic bag 2 with the movable or fixed upper and lower beams. It is convenient to insert the spout 86 including the elongated conduit 113 into the open end of the plastic bag 2 shown in FIG. 9, and heat seal or ultrasonic wave seal the plastic bag 2 and the spout 86 with each other.

What is claimed is:

1. An apparatus for intermittently and successively feeding sheet materials such as plastic bags into a plurality of sheet material processing stations which are spaced from each other along the feeding passage of sheet material, said apparatus comprising:

movable elongated member means extending parallel to the feeding direction of sheet material, said movable elongated member means including seat product holding means for holding and releasing said sheet materials;

fixed elongated member means extending parallel to said feeding direction of sheet material and disposed side by side with said movable elongated member means, said fixed elongated member means including sheet material holding means for holding and releasing said sheet materials;

drive means connected to said movable elongated member means, said movable elongated member being reciprocatingly moved in said feeding direction of sheet material by said drive means at a stroke corresponding to the distance between said processing stations; and activating means for activating said holding means of the movable and fixed elongated member means so that said sheet materials are held by said holding means of the movable elongated member means and released from said holding means of the fixed elongated member means when said movable elongated member means is forwardly moved, said sheet materials being held by said holding means of the fixed elongated member means and released from said holding means of the movable member means when said movable member means is reversely and backwardly moved.

2. The apparatus as set forth in claim 1 wherein said movable elongated member means comprises a plurality of movable elongated members, said fixed elongated member means comprising a plurality of fixed elongated members, said movable and fixed elongated members being disposed side by side and alternately with each other.

3. The apparatus as set forth in claim 1 or 2 wherein said movable and fixed elongated member means comprise movable and fixed lower beam means each including top surface means, the top surface means of said movable and fixed lower beam means being flush with each other, said sheet materials being held on said top surface means of said movable or fixed lower beam means.

4. The apparatus as set forth in claim 3 wherein at least one of said movable and fixed elongated member means further comprises movable or fixed upper beam means disposed above said movable or fixed lower beam means, said holding means comprising a plurality of clamp pads opposed to said top surface means of the movable or fixed lower beam means, said activating means comprising drive means mounted on said movable or fixed upper beam means and connected to said clamp pads for moving said clamp pads downward toward said top surface means to clamp and hold said sheet materials between said clamp pads and said top surface means.

5. The apparatus as set forth in claim 3 wherein said holding means comprises a plurality of suction holes formed in said top surface means of at least one of said movable and fixed lower beam means, said activating means comprising vacuum means connected to said suction holes for making said suction holes vacuous to thereby suctionally hold said sheet materials.

6. The apparatus as set forth in claim 1 or 2 wherein said movable elongated member means comprises movable upper and lower beam means, said movable upper beam means being disposed above said movable lower beam means, said fixed elongated member means comprising fixed lower beam means, said holding means comprising a plurality of first upper and lower pairs of clamp pads opposed to each other and disposed between said movable upper and lower beam means, and a plurality of second upper and lower pairs of clamp pads opposed to each other and disposed between said movable upper beam means and said fixed lower beam means, said activating means comprising a plurality of first upper and lower pairs of drive means and a plurality of second upper and lower pairs of drive means, said first upper and lower drive means being mounted on said movable upper and lower beam means and connected to said first upper and lower clamp pads respectively for moving said first upper and lower clamp pads downward and upward toward each other to clamp and hold said sheet materials between said first upper and lower clamp pads, said second upper and lower drive means being mounted on said movable upper beam means and said fixed lower beam means and connected to said second upper and lower clamp pads respectively for moving said second upper and lower clamp pads downward and upward toward each other to clamp and hold said sheet materials between said second upper and lower clamp pads and then moving said second upper clamp pads upward from said second lower clamp pads, said second lower clamp pads comprising vacuum pads, vacuum means being connected to the vacuum pads for making said vacuum pads vacuous to suctionally hold said sheet materials when and after moving said second upper clamp pads upward from said second lower clamp pads.

7. The apparatus as set forth in claim 1 or 2 wherein said movable elongated member means comprises movable upper and lower beam means, said movable upper be means being disposed above said movable lower beam means, said fixed elongated member means comprising fixed upper and lower beam means, said fixed upper beam means being disposed above said fixed lower beam means, said holding means comprising a plurality of first upper and lower pairs of clamp pads opposed to each other and disposed between said movable upper and lower beam means, and a plurality of second upper and lower pairs of clamp pads opposed to each other and disposed between said fixed upper and lower beam means, said activating means comprising a plurality of first upper and lower pairs of drive means and a plurality of second upper and lower pairs of drive means, said first upper and lower drive means being mounted on said movable upper and lower beam means and connected to said first upper and lower clamp pads respectively for moving said first upper and lower clamp pads downward and upward toward each other to clamp and hold said sheet materials between said first upper and lower clamp pads, said second upper and lower drive means being mounted on said fixed upper and lower beam means and connected to said second upper and lower clamp pads respectively for moving said second upper and lower clamp pads downward and upward toward each other to clamp and hold said sheet materials between said second upper and lower clamp pads.

8. The apparatus as set forth in claim 1 or 2 further comprising sheet material supply and discharge stations positioned at the opposite ends of said movable and fixed elongated member means in the longitudinal direction thereof, first delivery means for holding said sheet material at said supply station, and second delivery means for holding said sheet material at the last processing station, said first and second delivery means being mounted on and moved integrally with said movable elongated member means for intermittently and successively feeding said sheet materials into the first processing station from said supply station and into said discharge station from said last processing station.

9. The apparatus as set forth claim 1 or 2 wherein said sheet material comprises a plastic bag which has a certain shape including an open end, said processing stations comprising a plastic bag corner cut station, a plastic bag opening station and a plastic bag heat sealing or ultrasonic wave sealing station, said apparatus being arranged to intermittently and successively feed said plastic bags into said corner cut station, said opening station and said heat sealing or ultrasonic wave sealing station so that said plastic bags are inclined at an angle with respect to the feeding direction thereof and said open ends comprise the trailing ends of the plastic bags in the feeding direction thereof, said apparatus further comprising a cutter disposed at said corner cut station for obliquely cutting said plastic bag at one corner of said open end of the plastic bag, an opening device for opening said open end of the plastic bag at said opening station, and pickup fingers adapted to grasp an accessary such as a spout for inserting it into the cut corner of said open end, said opening device being mounted on and moved integrally with said movable elongated member means to intermittently feed said plastic bag with said open end opened into said heat sealing or ultrasonic wave sealing station, said pickup fingers being rotatingly moved with timed relation to said plastic bag in the feeding direction of the plastic bag and toward said open end of the plastic bag to insert said accessary into said cut corner of said open end at said heat sealing or ultrasonic wave station, said apparatus further comprising a heat sealing or ultrasonic wave sealing device disposed at said heat sealing or ultrasonic wave sealing station for heat sealing or ultrasonic wave sealing said plastic bag and said accessary with each other to adhere said plastic bag to said accessary.

10. The apparatus as set forth in claim 1 or 2 wherein said sheet product comprises a plastic bag which has a certain shape including an open end, said processing stations comprising a plastic bag corner cut station, a plastic bag opening station and a plastic bag heat sealing or ultrasonic wave sealing station, said apparatus being arranged to intermittently and successively feed said plastic bags into said corner cut station, said opening station and said heat sealing or ultrasonic wave sealing station so that said plastic bags are inclined at an angle with respect to the feeding direction thereof and said open ends comprise the leading ends of the plastic bags in the feeding direction thereof, said apparatus further comprising a cutter disposed at said corner cut station for obliquely cutting said plastic bag at one corner of said open end of the plastic bag, an opening device for opening said open end of the plastic bag at said opening station, and pickup fingers adapted to grasp an a acccssaln such as a spout for inserting it into the cut corner of said open end, said opening device being mounted on and moved integrally with said movable elongated member means to intermittently feed said plastic bag with said open end opened into said heat sealing or ultrasonic wave sealing station, said accessary being previously moved by said pickup fingers into a position corresponding to said cut corner of said open end before said plastic bag reaches said heat sealing or ultrasonic wave sealing station, to insert said accessary into said cut corner through said open end when said plastic bag reaches said heat sealing or ultrasonic wave sealing station, said apparatus further comprising a heat sealing or ultrasonic wave sealing device disposed at said heat sealing or ultrasonic wave sealing station for heat sealing or ultrasonic wave sealing said plastic bag and said accessary with each other to adhere said plastic bag to said accessary.

11. The apparatus as set forth in claim 1 or 2 wherein said sheet material comprises a plastic bag which has a certain shape including an open end, said processing stations comprising a plastic bag opening station and a plastic bag heat sealing or ultrasonic wave sealing station, said apparatus being arranged to intermittently and successively feed said plastic bags into said opening station and said heat sealing or ultrasonic wave sealing station so that said plastic bags extend perpendicularly to the feeding direction thereof, said apparatus further comprising an opening device for opening said open end of the plastic bag at said opening station, and pickup fingers adapted to grasp an accessary such as a spout for inserting it into said open end of the plastic bag, said opening device being mounted on and moved integrally with said movable elongated member means to intermittently feed said plastic bag with said open end opened into said heat sealing or ultrasonic wave sealing station, said pickup fingers being rotatingly moved with timed relation to said plastic bag in the feeding direction of the plastic bag and toward said open end of the plastic bag to insert said accessary into said open end of the plastic bag at said heat sealing or ultrasonic wave sealing station, said apparatus further comprising a heat sealing or ultrasonic wave sealing device disposed at said heat sealing or ultrasonic wave sealing station for heat sealing or ultrasonic wave sealing said plastic bag and said accessary with each other to adhere said plastic bag to said necessary.

12. The apparatus as set forth in claim 1 or 2 wherein said sheet material comprises a plastic bag which has a certain shape including an open end, said processing stations comprising a plastic bag opening station and a plastic bag heat sealing or ultrasonic wave sealing station, said apparatus being add to intermittently and successively feed said plastic bags into said opening station and said heat sealing or ultrasonic wave sealing station so that said plastic bags extend perpendicularly to the feeding direction thereof, said apparatus further comprising an opening device for opening said open end of the plastic bag at said opening station, and pickup fingers adapted to grasp an accessary such as a spout including an elongated conduit for inserting it into said open end of the patio bag, said opening device being mounted on and moved integrally with said movable elongated member means to intermittently feed said plastic bag with said open end opened into said heat sealing or ultrasonic wave sealing station, said pickup fingers being mounted on and moved integrally with said movable elongated member means and linearly moved toward said open end of the plastic bag to thereby insert said accessary into said open end of the plastic bag at said heat sealing or ultrasonic wave sealing station, said apparatus further comprising a heat sealing or ultrasonic wave sealing device disposed at said heat sealing or ultrasonic wave sealing station for heat sealing or ultrasonic wave sealing said plastic bag and said accessary with each other to adhere said plastic bag to said accessary.

* * * * *